US009022507B2

(12) United States Patent
Shiode

(10) Patent No.: US 9,022,507 B2
(45) Date of Patent: May 5, 2015

(54) TRANSPORT DEVICE AND IMAGE FORMATION APPARATUS

(75) Inventor: Takeshi Shiode, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 103 days.

(21) Appl. No.: 13/453,895

(22) Filed: Apr. 23, 2012

(65) Prior Publication Data

US 2012/0267468 A1 Oct. 25, 2012

(30) Foreign Application Priority Data

Apr. 25, 2011 (JP) ..... 2011-097264

(51) Int. Cl.
*B41J 29/38* (2006.01)
*B41J 15/16* (2006.01)
*B41J 11/00* (2006.01)

(52) U.S. Cl.
CPC ..... *B41J 15/16* (2013.01); *B41J 11/003* (2013.01)

(58) Field of Classification Search
CPC ..... B41J 11/42; B41J 29/393; B41J 29/38; B41J 3/60; B41J 11/0095
USPC ..... 347/16, 104
See application file for complete search history.

(56) References Cited

U.S. PATENT DOCUMENTS

2007/0051264 A1 3/2007 Sakamoto
2009/0226235 A1* 9/2009 Kobayashi et al. ..... 400/614
2009/0245912 A1 10/2009 Igarashi et al.
2010/0053251 A1* 3/2010 Igarashi et al. ..... 347/16
2011/0076083 A1* 3/2011 Tsurui et al. ..... 400/611
2011/0085842 A1* 4/2011 Igarashi ..... 400/613
2011/0240788 A1* 10/2011 Miyamoto ..... 242/419.5
2013/0235110 A1 9/2013 Igarashi et al.
2015/0009259 A1 1/2015 Igarashi et al.

FOREIGN PATENT DOCUMENTS

JP 2004-299120 10/2004
JP 2004-306363 11/2004
JP 03/22/2007 3/2007
JP 10/22/2009 10/2009
JP 2010-111057 5/2010

* cited by examiner

*Primary Examiner* — Manish S Shah
*Assistant Examiner* — Yaovi Ameh
(74) *Attorney, Agent, or Firm* — Workman Nydegger

(57) ABSTRACT

A transport device that includes a PF motor (that drives a PF roller which transports roll paper) and an intermediate motor (that drives an intermediate roller disposed on the upstream side of the PF roller), sets a slack removal force when transporting the roll paper so that the force applied to the paper in a direction opposite to the transport direction of the roll paper is larger as paper width of the roll paper is narrower, sets a slack removal torque as a torque to be outputted from the intermediate motor in accordance with the set slack removal force, and controls the driving of the intermediate motor to output the set slack removal torque. This makes it possible to cause the tension of the roll paper to be uniform regardless of the paper width so as to transport the roll paper precisely.

8 Claims, 5 Drawing Sheets

| | PAPER WIDTH | | |
|---|---|---|---|
| | 4 INCHES | ··· | 12 INCHES |
| NON-GLOSS | LARGER | SLACK REMOVAL FORCE F | |
| GLOSS | | | SMALLER |

TRANSPORT DEVICE AND IMAGE FORMATION APPARATUS

BACKGROUND

1. Technical Field

The present invention relates to a transport device that transports paper and an image formation apparatus that forms images by discharging liquid from a discharge head onto the paper which is transported by the transport device.

2. Related Art

As this type of transport device, devices have been previously proposed that include a roll in which roll paper is wound up, a first motor that rotationally drives the roll, a transport roller that transports the roll paper, and a second motor that rotationally drives the transport roller (for example, see JP-A-2010-111057). It has been considered that this transport device can precisely transport roll paper by a second motor rotationally driving a roll in a manner such that a specified tension is applied to the roll paper so as to prevent slack of the roll paper.

However, in a transport device that can set various kinds of paper in different paper widths, because the paper's own weight differs depending on the width of the paper that is set in place and transported, paper cannot be transported with stable precision in some cases; that is, paper is fed in a skewed manner and so on.

SUMMARY

An advantage of some aspects of the invention is to provide a transport device and an image formation apparatus with higher paper transport precision regardless of paper width.

The transport device and the image formation apparatus according to the invention employ the following configurations in order to achieve the above-mentioned advantage.

A transport device according to an aspect of the invention is a transport device that transports paper and includes: a tension application unit which applies tension to paper to be transported; a paper width detection unit which detects the paper width of the paper to be transported; and a control unit which controls the tension application unit to regulate the tension applied to the paper in accordance with the detected paper width.

In the transport device according to the aspect of the invention, the paper width of paper to be transported is detected and the tension application unit is controlled to regulate the tension applied to the paper in accordance with the detected paper width. This makes it possible to improve paper transport precision regardless of the paper width.

In the transport device according to the aspect of the invention, it is preferable that the control unit be a unit that controls the tension application unit so that the tension is likely to be stronger as the detected paper width is narrower. This makes it possible to make paper tension approximately uniform regardless of paper width.

According to another aspect of the invention, in the transport device of the invention, it is preferable for the control unit to be a unit that controls the tension application unit to make the paper tension approximately constant regardless of the detected paper width.

According to another aspect of the invention, it is preferable that the transport device of the invention further include a storage unit in which a table is previously stored. The table associates paper widths of the paper with the tension to be applied to the paper. The control unit reads out a corresponding tension from the table stored in the storage unit according to the detected paper width and controls the tension application unit according to the tension that was read out.

According to still another aspect of the invention, it is preferable that the transport device further include a first roller that transports paper and a second roller disposed on the upstream side of the first roller. Further, it is also preferable that the tension application unit be an electric motor that rotationally drives the second roller so as to cause the tension applied to the paper to be in a direction opposite the transport direction of the paper. It is yet further preferable that the control unit be a unit that sets tension based on the detected paper width, sets a rotational load being exerted on the electric motor based on rotational speed of the electric motor, and controls the driving of the electric motor so that a force obtained by adding the set tension to the set rotational load is exerted thereon. This makes it possible to regulate the tension of paper by a simple process.

An image formation apparatus according to an aspect of the invention includes any one of the transport devices according to the aforementioned aspects of the invention and forms images by discharging liquid from a discharge head onto paper transported by the transport device.

Since the image formation apparatus according to the aspect of the invention is equipped with the aforementioned transport device of the invention, higher paper transport precision can be obtained regardless of paper width. As a result, the image quality of an image formed on the paper that is transported by the transport device can be greatly improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
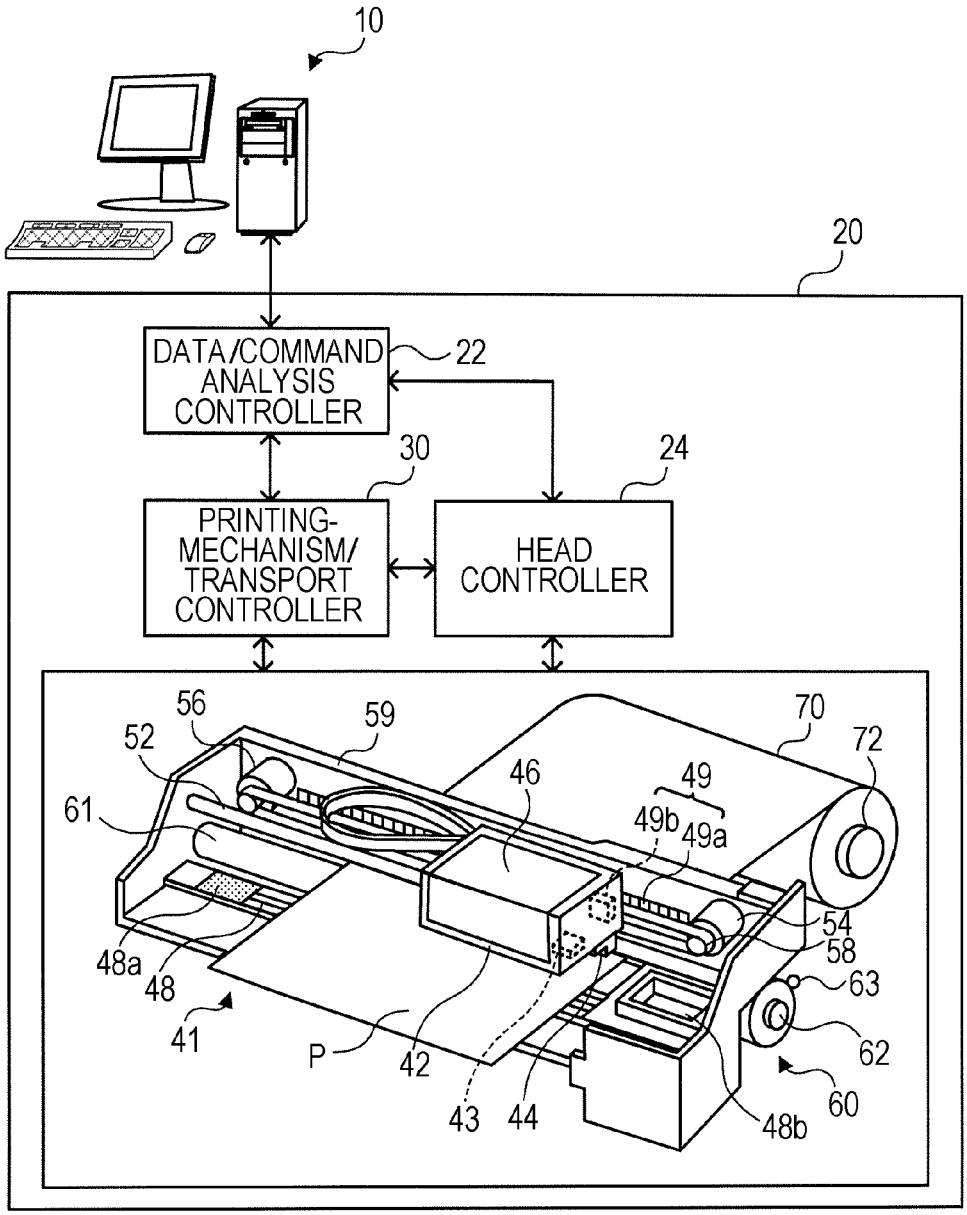
FIG. 1 is a diagram schematically illustrating the configuration of an ink jet printer according to an embodiment of the invention.
Figure 2:
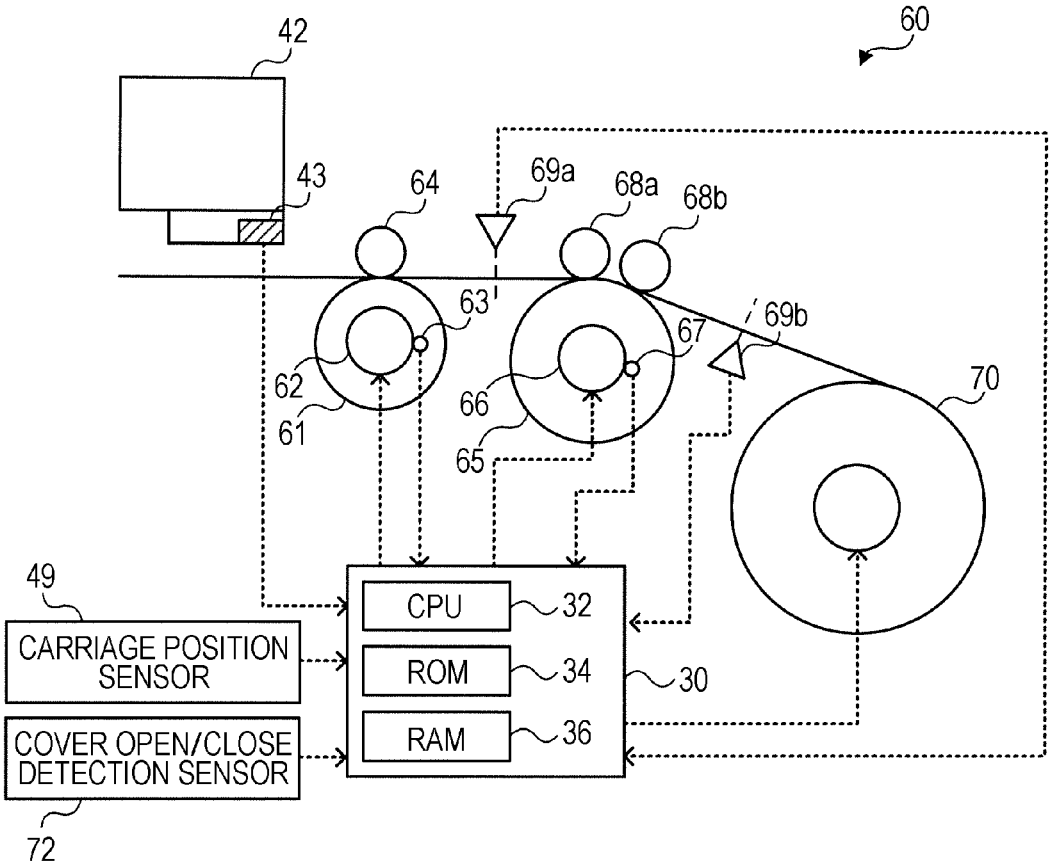
FIG. 2 is a diagram schematically illustrating the configuration of a transport device according to an embodiment of the invention.

Hereinafter, embodiments of the invention will be described with reference to the drawings. FIG. 1 is a diagram schematically illustrating the configuration of an ink jet printer 20 according to an embodiment of the invention, and FIG. 2 is a diagram schematically illustrating the configuration of a transport device 60.

As shown in FIG. 1, the ink jet printer 20 according to the embodiment includes, as its mechanism: a transport device 60 that transports roll paper P in a sub scanning direction (direction from the rear toward the front of the printer in FIG. 1); and a printer mechanism 41 that performs printing on the roll paper P transported by the transport device 60 onto a platen 48 by discharging ink droplets thereon through nozzles of a print head 44 while the print head 44 moving in a main scanning direction (right-and-left direction in FIG. 1). A capping device 48*b* is disposed at one end of the platen 48 in the main scanning direction (right end in FIG. 1) so as to seal a nozzle surface of the print head 44, whereas a flushing area 48*a* is provided at the other end of the platen 48 in the main scanning direction (left end in FIG. 1) where a flushing operation in which ink droplets are discharged through the nozzles of the print head 44 is performed periodically so as to prevent clogging of the nozzles.

The printer mechanism 41 includes, as shown in FIG. 1: a carriage 42 that can move back and forth guided by a carriage guide 52 in the main scanning direction; a carriage motor 54 and a slave roller 56 that are respectively disposed at one end side and the other end side of the carriage guide 52; a carriage belt 58 that is stretched upon between the carriage motor 54 and the slave roller 56 and is mounted to the carriage 42; an ink cartridge 46 that is mounted on the carriage 42 and stores color inks of cyan (C), magenta (M), yellow (Y) and black (K); and the print head 44, in which a plurality of nozzles are formed, that discharges ink droplets by pressurizing each color ink supplied from the ink cartridge 46.

The carriage 42 is caused to move back and forth in the main scanning direction by the carriage motor 54 driving the carriage belt 58. On the rear side of the carriage 42, a carriage position sensor 49 that detects a position of the carriage 42 in the main scanning direction is provided. The carriage position sensor 49 includes a linear optical scale 49*a* disposed on a frame 59 along the carriage guide 52 and an optical sensor 49*b* that is attached to the rear surface of the carriage 42 opposing the optical scale 49*a* and optically reads the optical scale 49*a*. Further, a paper width detection sensor 43 is attached to the lower surface of the carriage 42 so as to detect paper width of the roll paper P. The paper width detection sensor 43 is configured as an optical sensor having a light emitting element such as a light-emitting diode and a light receiving element such as a phototransistor. However, the configuration of the above sensor is not illustrated in detail. The light receiving element receives light, which is emitted from the light emitting element and reflected by the roll paper P, so as to convert the light into an electric signal having a voltage that is proportional to the quantity of light. By causing the carriage 42 to move in the main scanning direction across the roll paper P while the light being emitted from the light emitting element, the paper width detection sensor 43 can detect the left and right ends of the roll paper P based on the electric signals obtained by the light receiving element because reflectance of light at the platen 48 and reflectance of light at the roll paper P are different from each other. Then, the paper width can be obtained by finding a difference between two positions of the carriage 42 detected by the carriage position sensor 49 just when the right and left ends of the roll paper P are respectively detected by the paper width detection sensor 43.

As shown in FIG. 2, the transport device 60 includes: a roll 70 in which roll paper P is wound up; a paper feed (PF) roller 61 that transports roll paper P onto the platen 48; a PF motor 62 that rotationally drives the PF roller 61; a guide roller 64 that is driven as a pair with the PF roller 61; an intermediate roller 65 disposed between the PF roller 61 and the roll 70; an intermediate motor 66 that rotationally drives the intermediate roller 65; guide rollers 68*a*, 68*b* that are driven as a pair with the intermediate roller 65; and a printing-mechanism/transport controller 30 that controls the entire device. Rotary encoders 63, 67 are respectively attached to the rotation axes of the PF motor 62 and the intermediate motor 66 so as to detect rotational amounts thereof, whereby driving control of the PF motor 62 and the intermediate motor 66 is performed based on the rotational amounts detected by the rotary encoders 63, 67. The driving control of the PF motor 62 and the intermediate motor 66 is performed with pulse width modulation (PWM) control in which a driving voltage is controlled through changing a duty. The rotary encoders 63, 67 are each configured with a rotary scale (not shown) (which is graduated at predetermined rotation-angle intervals) and a rotary scale sensor (not shown) (which reads out the graduations on the rotary scale). Further, paper detection sensors 69*a*, 69*b* (that are configured as optical sensors so as to detect paper presence/absence, paper ends, and so on of roll paper P) are installed between the PF roller 61 and intermediate roller 65 and between the intermediate roller 65 and roll 70, respectively. In addition, in the transport device 60, a roll cover is attached to a housing (not shown) that accommodates the roll 70, and an operation of exchanging roll paper P is performed with the roll cover being opened.

The ink jet printer 20 of this embodiment includes, as its control system: a data/command analysis controller 22 that inputs various kinds of commands including a print job from a control computer (control PC) 10 and analyzes the inputted command so as to execute necessary processing such as creating print data and the like; a head controller 24 that inputs the print data from the data/command analysis controller 22 and controls the driving of the print head 44 so that ink is discharged through the nozzles in accordance with the inputted print data; and the printing-mechanism/transport controller 30 that controls movement of the carriage 42, transport of the roll paper P, and so on. The data/command analysis controller 22, the head controller 24 and the printing-mechanism/transport controller 30 communicate with one another via communications ports so as to exchange control signals, data and so on. The data/command analysis controller 22 and the head controller 24 are configured as a microprocessor in which a CPU plays a major role. The microprocessor includes, in addition to the CPU, a ROM that stores a processing program, a RAM that temporarily stores data, input/output ports and communications ports. Note that details of this microprocessor are not shown in the drawings.

The printing-mechanism/transport controller 30 in the transport device 60 of the embodiment is configured as a microprocessor in which a CPU 32 plays a major role; the microprocessor includes, in addition to the CPU 32, a ROM 34 that stores a processing program, various kinds of tables and the like, a RAM 36 that temporarily stores data, input/output ports and communications ports. The printing-mechanism/transport controller 30 inputs, via the input port, a rotational position of the PF roller 61 from the rotary encoder 63, a rotational position of the intermediate roller 65 from the rotary encoder 67, detection signals from the paper detection sensors 69*a*, 69*b*, a carriage position from the carriage position sensor 49, a detection signal from the paper width detection sensor 43, an open/close signal from a cover open/close detection sensor 72 that detects the opening/closing of the roll cover, and so on. Further, the printing-mechanism/transport controller 30 outputs a driving signal to the PF motor 62, a driving signal to the intermediate motor 66, and the like via the output port. Furthermore, the printing-mechanism/transport controller 30 calculates a rotational speed Vpf of the PF roller 61 based on the rotational position of the PF roller 61 reported from the rotary encoder 63, calculates a rotational speed Vmd of the intermediate roller 65 based on the rotational position of the intermediate roller 65 reported from the rotary encoder 67, and so on.

With the ink jet printer 20 of the embodiment configured as described above, when image data is inputted to the data/ command analysis controller 22 accompanying a print command from the control PC 10, the data/command analysis controller 22 resizes and color-converts the inputted image data (RGB) into CMYK data; performs half-tone processing on the color-converted CMYK data to binarize the data and creates print data; and transmits the created print data to the head controller 24 and the printing-mechanism/transport controller 30. Then, the printing-mechanism/transport controller 30 drives the PF motor 62 and intermediate motor 66 to rotate the PF roller 61 and intermediate roller 65 so that the roll paper P is transported onto the platen 48, and makes the carriage 42 move back and forth using the carriage motor 54, during which the head controller 24 drives the print head 44 so as to discharge each color ink at a discharge timing according to the print data, thereby forming an image on the roll paper P. After the formation of an image on the roll paper P, the printing-mechanism/transport controller 30 cuts the roll paper P with a cutting mechanism (not shown) and transports the cut paper to a discharge tray (not shown).

Figure 3:
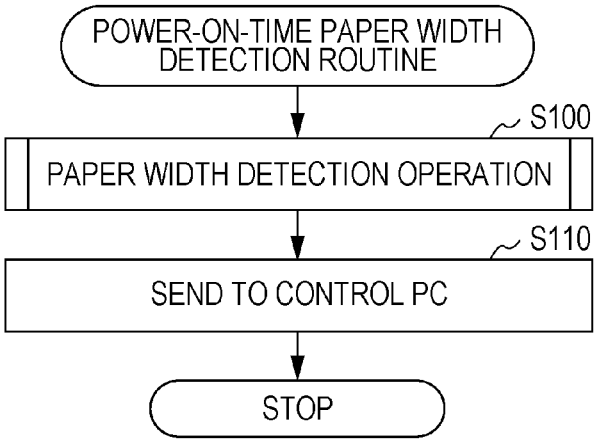
FIG. 3 is a flowchart illustrating an example of a power-on-time paper width detection routine.
Figure 4:
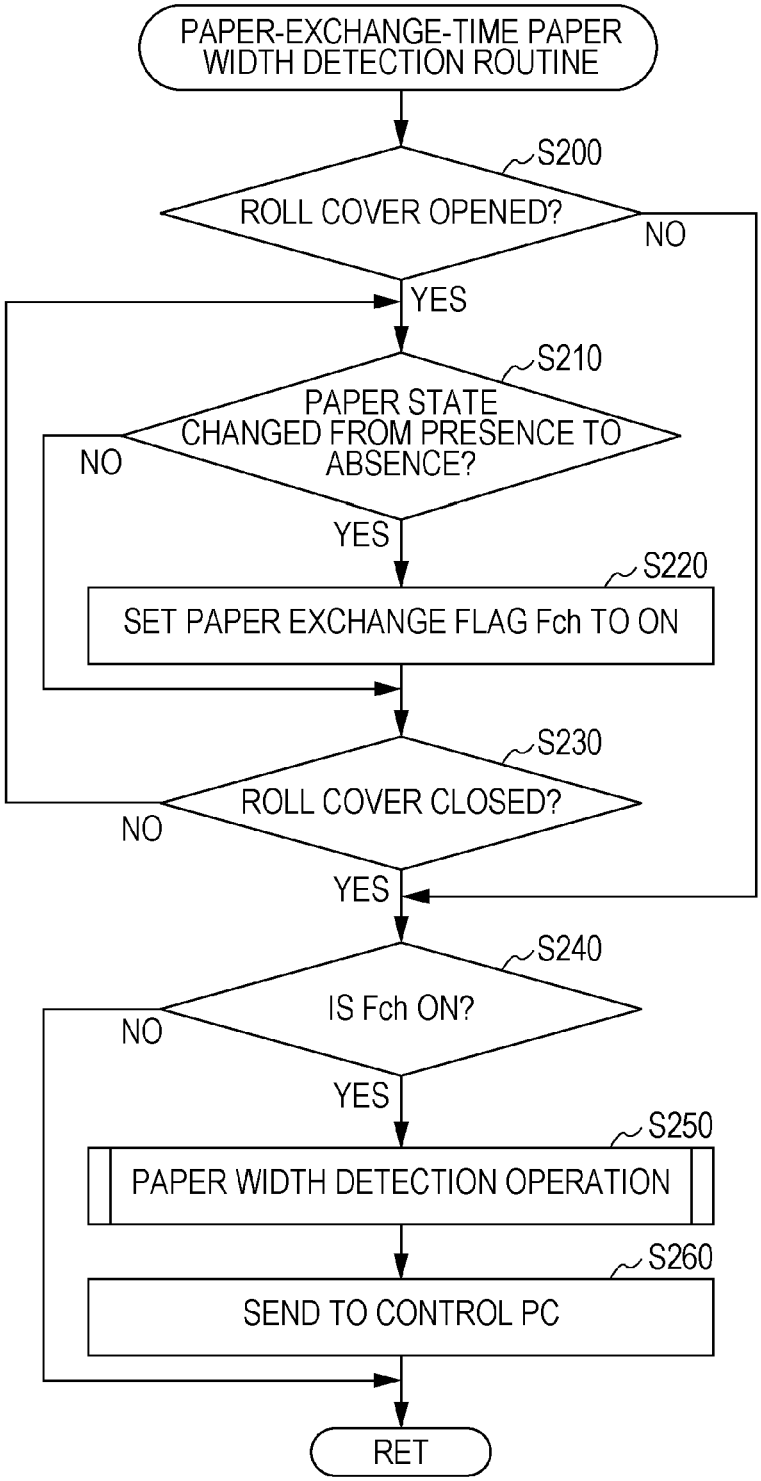
FIG. 4 is a flowchart illustrating an example of a paper-exchange-time paper width detection routine.

Next, operations of the transport device 60 according to the embodiment, particularly operations when paper width of roll paper P is detected and operations when roll paper P is transported at the beginning of printing, will be described. Hereinbelow, operations when paper width of roll paper P is detected are described first. Thereafter operations when roll paper P is transported at the beginning of printing are described. FIG. 3 is a flowchart illustrating an example of a power-on-time paper width detection routine executed by the printing-mechanism/transport controller 30, and FIG. 4 is a flowchart illustrating an example of a paper-exchange-time paper width detection routine executed also by the printing-mechanism/transport controller 30. In the power-on-time paper width detection routine, when the power of the ink jet printer 20 is turned on, a paper width detection operation is executed (step S100) and the paper width obtained by the paper width detection operation is sent to the control PC 10 (step S110). The paper width detection operation is executed as follows: the carriage 42 is moved across the roll paper P in the main scanning direction while the light emitting element of the paper width detection sensor 43 emits light as described earlier; right and left ends of the roll paper P are detected based on electric signals obtained by the light receiving element thereof; then the paper width is obtained by finding a difference between two positions of the carriage 42 detected by the carriage position sensor 49 at the point when the right and left ends are detected. In the paper-exchange-time paper width detection routine, it is determined whether or not the roll cover is opened according to an open/close signal from the cover open/close detection sensor 72 (step S200). In the case where the roll cover is opened, it is determined whether or not a signal detected by the paper detection sensor 69*b* indicates that the state of roll paper P has changed from presence to absence (step S210). This determination processing determines whether or not the roll paper P has been detached from the transport device 60. If it is determined that the state of roll paper P has not changed from presence to absence, the sequence of the routine returns to step S210 to repeat the processing therefrom until the roll cover is found to be closed (step S230). If it is determined that the state of roll paper P has changed from presence to absence, a paper exchange flag Fch is set to ON (step S220). The paper exchange flag Fch is set to ON when the roll paper P is exchanged, and it is set to OFF in the initial state. Because the exchange of roll paper P is carried out with the roll cover being opened in this embodiment, the processing of steps S200 through S230 are processings in which it is determined that the roll paper P is exchanged if the roll cover has been opened and thereafter the state of roll paper P has changed from being detected to not detected. If the roll cover is found to be closed at step S200 or S230, then it is determined whether or not the paper exchange flag Fch is ON (step S240). In the case where the paper exchange flag Fch is ON, the aforementioned paper width detection operation is executed (step S250), the paper width obtained by the paper width detection operation is sent to the control PC 10 (step S260), and then the present routine is ended. Note that if the paper exchange flag Fch is OFF, the present routine is ended without executing the paper width detection operation.

Figure 5:
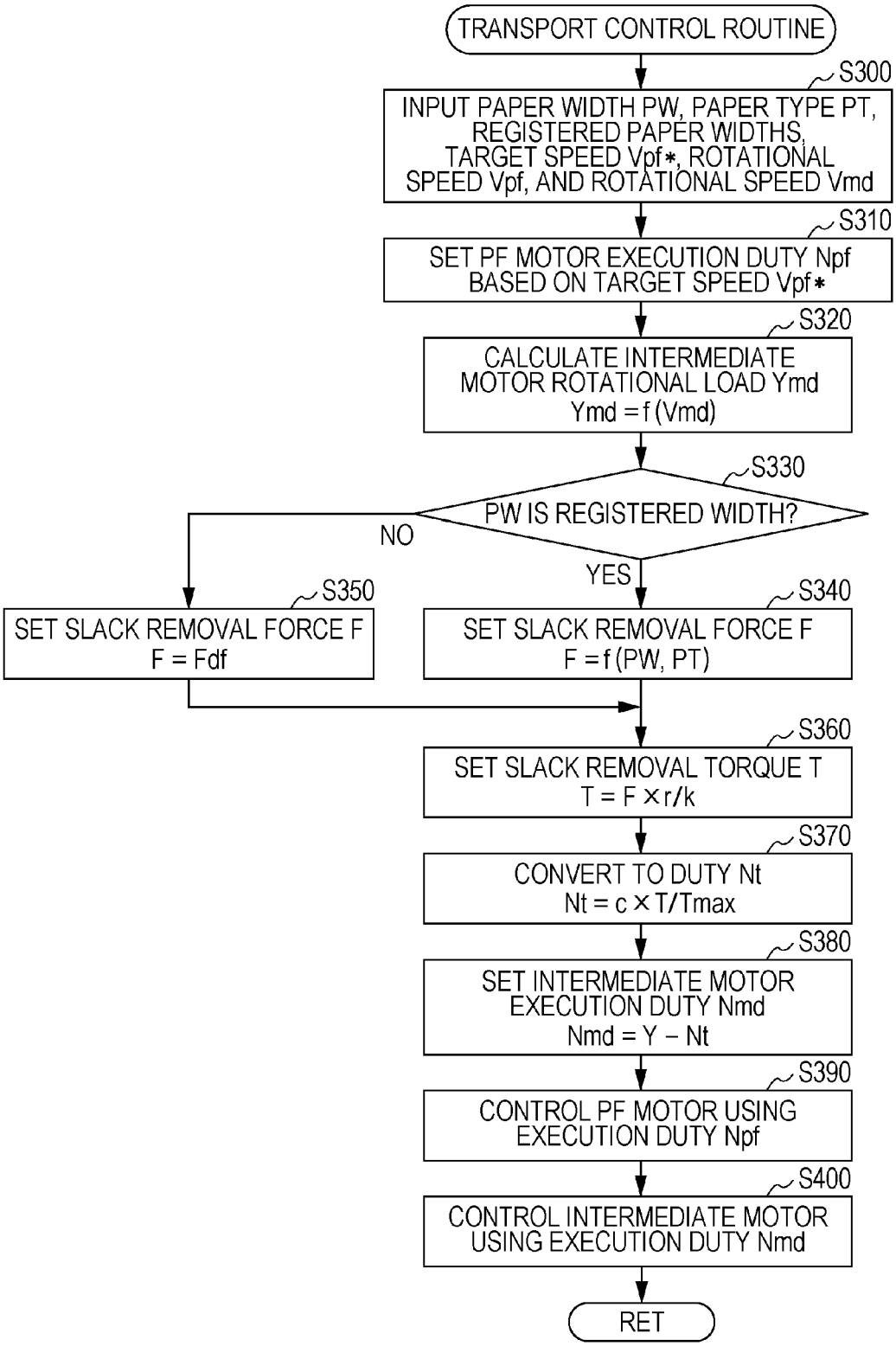
FIG. 5 is a flowchart illustrating an example of a transport control routine.

Next, operations that transport roll paper P at the beginning of printing will be described. FIG. 5 is a flowchart illustrating an example of a transport control routine executed by the printing-mechanism/transport controller 30. This routine is executed when the data/command analysis controller 22 has issued a command to transport.

Figures 6, 7:
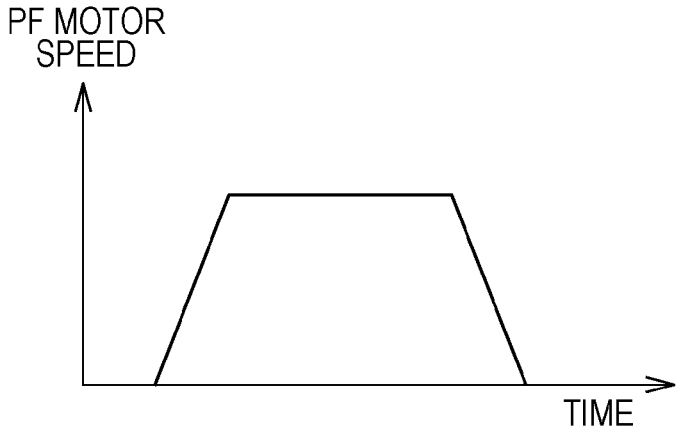
FIG. 6 is a descriptive diagram indicating the change over time of a PF motor target speed.
FIG. 7 is a descriptive diagram illustrating an example of a table for setting slack removal force.

In the transport control routine, a processing that inputs the following data items necessary in the transport control is first executed (step S300): a paper width PW of roll paper p from the paper width detection sensor 43, a paper type PT, registered paper widths, a target speed Vpf* of the PF motor 62, a current rotational speed Vpf of the PF motor 62 from the rotary encoder 63, a current rotational speed Vmd of the intermediate motor 66 from the rotary encoder 67, and so on. Here, as shown in FIG. 6, the target speed Vpf* is set so as to maintain a constant speed for a predetermined period of time after having been accelerated at a predetermined rate, and thereafter is caused to decrease at a predetermined rate. A total of six types of registered paper widths, ranging from 4 to 12 inches, are inputted as the registered paper widths in this embodiment. As for the paper type PT, there are two types, i.e., paper with gloss (glossy paper) and paper without gloss (plain paper, matt paper, or the like). In this embodiment, a user specifies and inputs a desired paper type via the control PC 10. When the data is inputted in the manner described above, an execution duty Npf of the PF motor 62 is set based on the inputted target speed Vpf* and current rotational speed Vpf (step S310). In this embodiment, the execution duty Npf is set through feedback control based on a deviation between the current rotational speed Vpf and the target speed Vpf* so that the current rotational speed Vpf comes closer to the target speed Vpf*.

Subsequently, a rotational load (duty) Y of the intermediate motor 66 is calculated based on the inputted rotational speed Vmd of the intermediate motor 66 (step S320). Here, the rotational load Y is calculated as follows: in a measurement operation that is executed at the power-on time, for example, two rotational speeds X1, X2 are set as target speeds and the intermediate motor 66 is rotated at each of the target speeds; the execution duties of the intermediate motor 66 when rotated at the target speeds are respectively set as rotational loads Y1, Y2; linear interpolation is performed based on two combinations of the rotational speeds X1, X2 and the rotational loads Y1, Y2 so as to derive a relation in advance between an arbitrary rotational speed X and the rotational load Y as expressed by Equation 1 described below; then the rotational load Y is set by substituting the rotational speed Vmd for the X in Equation 1 when the rotational speed Vmd of the intermediate motor 66 is given. This rotational load Y can be considered to be a load necessary to rotate the intermediate motor 66 at the rotational speed X.

$$Y=(Y2-Y1)/(X2-X1)\times X+Y1-(Y2-Y1)/(X2-X1)\times X1 \quad \text{(Equation 1)}$$

Next, it is determined whether or not any of the registered paper widths having been inputted coincides with the inputted paper width PW. In other words, it is determined whether or not the detected paper width PW is a width registered as one of the registered paper widths (step S330); if the paper width PW is a width registered as one of the registered paper widths, a slack removal force F is set based on the inputted paper width PW and paper type PT (step S340). Here, the slack removal force F is a force applied to roll paper P in a direction opposite to the roll paper transport direction so as to remove the slack of roll paper P when roll paper P is transported by the PF motor 62. In this embodiment, the slack removal force F is set as follows: the relation of the slack removal force F to the paper width PW and paper type PT is previously obtained and stored in the ROM 34 as a table; and thereafter when the paper width PW and the paper type PT are given, the corresponding slack removal force F is acquired from the aforementioned table and set. FIG. 7 is an example of the table. The slack removal force F is set larger when transporting non-glossy paper than when transporting glossy paper and also set larger as the paper width PW is narrower so that the tension of the roll paper P is always constant regardless of the paper width PW, the paper type PT and so on. Note that the slack removal force F is made larger as the paper width PW is narrower depending on the following reason. That is, as the paper width PW is narrower, paper's own weight becomes lighter; this causes the tension applied to the roll paper P to be smaller resulting in the paper being likely in a slack state. If the paper width PW is not a width registered as one of the registered paper widths, a predetermined default value Fdf is set to the slack removal force F (step S350).

After having set the slack removal force F, a slack removal torque T that the intermediate motor 66 needs to generate is calculated with Equation 2 described below based on the set slack removal force F (step S360), and then the calculated slack removal torque T is converted to a duty Nt, which is used in PWM control, with Equation 3 described below (step S370). Here, "r" in Equation 2 is the diameter of the intermediate roller 65 and "k" denotes a coefficient. Meanwhile, "c" in Equation 3 is the maximum count value in a cycle and "Tmax" is the maximum torque at the startup time of the intermediate motor 66. Then, a value obtained by subtracting the slack removal duty Nt from the rotational load Y having been set in step S320 is set as an execution duty Nmd of the intermediate motor 66 (step S380). Having set the execution duty Npf of the PF motor 62 and the execution duty Nmd of the intermediate motor 66 as described above, PWM control is performed on the PF motor 62 using the set execution duty Npf (step S390) and PWM control is also performed on the intermediate motor 66 using the set execution duty Nmd (step S400), then the present routine is ended.

$$T=F\times r/k \quad \text{(Equation 2)}$$

$$Nt=c\times T/T\max \quad \text{(Equation 3)}$$

Hereinbelow, correspondence between constituent elements of the embodiment and constituent elements of the aspects of the invention will be clarified. The intermediate motor 66 of the embodiment corresponds to the "tension application unit" of the aspects of the invention; the paper width detection sensor 43, the carriage position sensor 49, and the printing-mechanism/transport controller 30 that executes the power-on-time paper width detection routine shown in FIG. 3 and the paper-exchange-time paper width detection routine shown in FIG. 4 collectively correspond to the "paper width detection unit"; and the printing-mechanism/transport controller 30 that executes the transport control routine shown in FIG. 5 corresponds to the "control unit".

According to the ink jet printer 20 of the embodiment described thus far, the PF motor 62 (that drives the PF roller 61 which transports roll paper P) and the intermediate motor 66 (that drives the intermediate roller 65 disposed on the upstream side of the PF roller 61) are included therein. Furthermore, the paper width PW of roll paper P is detected when the roll paper P is transported, and the intermediate motor 65 is driven so as to make the slack removal force F in a direction opposite to the transport direction of roll paper P larger as the detected paper width PW is narrower. Thus, thus the tension of the roll paper P can be made uniform regardless of the paper width PW. As a result, the roll paper P can be precisely transported.

In the ink jet printer 20 according to the embodiment, although the slack removal force F that is applied to roll paper P in a direction opposite to the transport direction is set based on the paper width PW and paper type PT, the slack removal force F may be set based on only the paper width PW.

In the ink jet printer 20 according to the embodiment, although the slack removal force F is set based on the paper width PW using the table as shown in FIG. 7, embodiments are not limited thereto and a value obtained by multiplication of the paper width PW by a coefficient may be set as a slack removal force F.

In the ink jet printer 20 according to the embodiment, although the paper width PW is detected at the power-on time and paper-exchange time, embodiments are not limited thereto and the paper width PW may be detected every time printing is started, for example.

Although the invention is applied in the ink jet printer 20 and explained in this embodiment, the invention is not limited thereto and can be applied in any apparatus with a transport device included therein that transports paper. In addition, the invention may be embodied in a form of transport device.

The invention is not intended to be limited to the aforementioned embodiments in any way, and it is needless to say that various kinds of variations can be made without departing from the technical range and scope of the invention.

The entire disclosure of Japanese Patent Application No. 2011-097264, filed Apr. 25, 2011 is expressly incorporated by reference herein.

What is claimed is:

1. A transport device that transports paper, the transport device comprising:

a tension application unit that applies tension to paper to be transported at a location disposed between a roll on which paper is wound and a paper feed roller that transports paper, the tension application unit applying a rotational force to the paper to apply the tension;

a paper width detection unit that detects a paper width of the paper to be transported; and a control unit that controls the tension application unit to regulate the tension applied to the paper in accordance with the detected paper width and a paper type of the paper selected from gloss paper or non-gloss paper, wherein the control unit controls the tension application unit so that the tension is likely to be stronger as the detected paper width is narrower.

2. The transport device according to claim 1, wherein the control unit controls the tension application unit to make the tension of the paper approximately constant regardless of the paper width of each paper transported by the transport device.

3. The transport device according to claim 1, further including:

a storage unit storing a table, the table associating paper widths of the paper with the tension applied to the paper, wherein the control unit reads out a corresponding tension from the table stored in the storage unit according to the detected paper width and controls the tension application unit according to the tension read out from the table.

4. The transport device according to claim 1, further including:

a first roller that transports paper; and a second roller disposed on an upstream side of the first roller, wherein the tension application unit is an electric motor that rotationally drives the second roller such that tension can be applied to the paper in a direction opposite to a transport direction of the paper, and the control unit sets tension based on the detected paper width, sets a rotational load being exerted on the electric motor based on a rotational speed of the electric motor, and controls driving of the electric motor so that a force obtained by adding the set tension to the set rotational load is exerted thereon.

5. An image formation apparatus comprising the transport device according to claim 1, wherein the image formation apparatus forms images by discharging liquid from a discharge head onto paper transported by the transport device.

6. An image formation apparatus comprising the transport device according to claim 2, wherein the image formation apparatus forms images by discharging liquid from a discharge head onto paper transported by the transport device.

7. An image formation apparatus comprising the transport device according to claim 3, wherein the image formation apparatus forms images by discharging liquid from a discharge head onto paper transported by the transport device.

8. An image formation apparatus comprising the transport device according to claim 4, wherein the image formation apparatus forms images by discharging liquid from a discharge head onto paper transported by the transport device.

* * * * *